US008449041B2

(12) United States Patent
Monyak et al.

(10) Patent No.: US 8,449,041 B2
(45) Date of Patent: May 28, 2013

(54) GRADING PICK WITH EXTENDED FINS

(75) Inventors: Kenneth Monyak, Abingdon, VA (US); Daniel Mouthaan, Williamsburg, MI (US); Joseph Fader, Abingdon, VA (US)

(73) Assignee: Sandvik Intellectual Property AB, Sandviken (SE)

( * ) Notice: Subject to any disclaimer, the term of this patent is extended or adjusted under 35 U.S.C. 154(b) by 332 days.

(21) Appl. No.: 12/912,981

(22) Filed: Oct. 27, 2010

(65) Prior Publication Data

US 2012/0104830 A1 May 3, 2012

(51) Int. Cl.
*E21C 35/19* (2006.01)

(52) U.S. Cl.
USPC ..... 299/106; 299/110

(58) Field of Classification Search
USPC ..... 299/105, 111, 110, 106
See application file for complete search history.

(56) References Cited

U.S. PATENT DOCUMENTS

| | | | | | |
|---|---|---|---|---|---|
| 1,550,669 | A | * | 8/1925 | Bowman | 299/83.1 |
| 1,903,772 | A | * | 4/1933 | Bowman | 299/83.1 |
| 2,783,038 | A | * | 2/1957 | Tracy | 299/110 |
| 3,361,481 | A | * | 1/1968 | Maddock | 299/110 |
| 3,476,438 | A | * | 11/1969 | Bower, Jr. | 299/110 |
| 3,652,130 | A | | 3/1972 | Elders | |
| 3,833,264 | A | * | 9/1974 | Elders | 299/110 |
| 3,833,265 | A | * | 9/1974 | Elders | 299/104 |
| RE30,807 | E | * | 12/1981 | Elders | 299/110 |
| 4,497,520 | A | * | 2/1985 | Ojanen | 299/111 |
| 6,981,496 | B2 | * | 1/2006 | Szendrovari et al. | 125/41 |
| 2007/0257545 | A1 | | 11/2007 | Mouthaan et al. | |

FOREIGN PATENT DOCUMENTS

| | | |
|---|---|---|
| DE | 20 2007 018 885 | 9/2009 |
| SU | 751991 | 7/1980 |

OTHER PUBLICATIONS

International Search Report for PCT/US2011/053574, dated Feb. 21, 2012.

* cited by examiner

*Primary Examiner* — John Kreck
(74) *Attorney, Agent, or Firm* — Morgan, Lewis & Bockius LLP

(57) ABSTRACT

A tool pick including a head portion, a larger diameter shoulder positioned rearwardly adjacent to the head portion and joined to the head portion at a junction, and a shank extending rearwardly with respect to the shoulder. Two or more fins extend generally radially outward from the head portion and the shoulder, each fin having an outer surface sloping outwardly and rearwardly from the head portion and a pair of side surfaces, a rear end of each fin being located rearward of the junction between the head portion and the shoulder, the fins defining a maximum diameter of at least about 105% of the diameter of the shoulder such that the outer surface of the fin at an axial position aligned with the junction is located radially outward with respect to the junction.

15 Claims, 4 Drawing Sheets

GRADING PICK WITH EXTENDED FINS

FIELD

The present disclosure relates to a rotatable grading pick having extended fins to promote rotation and penetration. More particularly, the present disclosure relates to a rotatable grading pick for road, milling or construction applications having a head portion of narrower diameter than the head portion of a standard road milling or construction pick flanked by fins that buttress the head portion and provide leverage for debris to rotate the pick within a holder.

BACKGROUND

In the discussion of the background that follows, reference is made to certain structures and/or methods. However, the following references should not be construed as an admission that these structures and/or methods constitute prior art. Applicant expressly reserves the right to demonstrate that such structures and/or methods do not qualify as prior art.

Road grading machines include a mounting block that holds one more or rotatable grading tool picks that rotate during operation. The grading picks each have a tip portion that contacts the surface of a road or the ground that is to be milled. To maximize the working life of the tip portion, and thus of the pick, continuous rotational movement of the pick, is essential. Rotation enables the tip portion to be exposed to the road surface from all angles and thus to wear substantially uniformly around its circumference.

FIG. 1 shows a prior art mining pick having fins that surround a head portion of the pick. Mining picks are subjected to very different operating conditions that grading picks. In particular, the material (earth) contacted by mining picks is substantially softer and less abrasive than the material (asphalt, concrete, etc.) contacted by grading picks, such that the forces applied to the tip portion of a mining pick are substantially less than those applied to a grading pick. As a result, the head portion and tip portion of a mining pick have smaller diameters, and the tip portion has less material, than their corresponding parts in a grading pick. Additionally, the softer mining materials are less likely to lodge between the tool pick and the mounting block to prevent rotation of the pick during operation. In the mining pick as shown, a front end of the head portion supports a tip portion. An outer edge of each fin extends frontwardly and radially inwardly from a shoulder located at a rear end of the head portion, the fins terminating near the front end of the head portion. The maximum diameter of the fins is less than or equal to the diameter of the shoulder.

FIGS. 2 and 3 show a prior art grading pick 10. The pick 10 has a front end 12 and a rear end 14. The pick 10 includes a tapered head portion 16, a cutting tip 18 projecting frontwardly from the head portion 16, and a shoulder 20 rearwardly adjacent to the head portion 16 and joining the head portion 16 at a junction 141. A reduced diameter puller groove 22 is disposed rearwardly adjacent to the shoulder 20, and is sized to receive the jaws of a standard extractor tool, as known in the art. Projecting rearwardly form the puller groove 22 is a shank 26 having a diameter sized to be received in a bore in a mounting block (not shown). A tapered portion of the shank 26 immediately adjacent to the puller groove 22 may have a diameter slightly larger than that of the shank 26 to serve as a washer seat 24.

During operation, debris, such as fines, dust, grit, pebbles, dirt, and the like, is produced and can lodge between the grading pick and its mounting block. The debris can become packed and hamper rotation of the pick, and may eventually prevent the pick from rotating entirely, resulting in premature failure of the pick. Conventional picks rely on unbalanced forces between the road surface and the tip portion to cause rotation of the pick within its mounting block, but those unbalanced forces on the tip portion are frequently insufficient to overcome the friction caused by the debris. In such cases, if the lack of rotation of the pick is noticed, an operator may need to manually loosen the grading pick, which is extremely time consuming. But in many cases, either, the lack of rotation goes unnoticed until it is too late, or the operator avoids rotating the pick so the machine can be returned to operation sooner, thereby dramatically shortening the expected life of the pick.

The tip portion of a grading pick is subjected to substantial stresses during operation, and therefore grading picks commonly have a large diameter head portion supporting the tip portion. However, a large diameter head portion demands greater forces than a smaller diameter head portion to achieve the same penetration depth into the road surface.

Accordingly, there is a need in the art for a grading pick that is able to continue to rotate despite the frictional forces imposed by debris generating during operation, and for a grading pick having a smaller diameter head portion to achieve greater penetration into the road surface.

SUMMARY

The disclosed grading tool pick with extended fins both increases the rotation of the tool pick during operation and improves the penetration of the tool pick into a target surface. The tool pick includes fins that extend rearwardly and radially outwardly with respect to a head portion of the tool pick, the fins providing side surfaces to be contacted by debris which causes the pick to rotate.

An exemplary embodiment of a tool pick includes a head portion having a diameter, a shoulder positioned rearwardly adjacent to the head portion and being joined to the head portion at a junction, the shoulder having a diameter greater than the diameter of the head portion, and a shank extending rearwardly with respect to the shoulder. Two or more fins extend generally radially outward from the head portion and the shoulder. Each fin has an outer surface sloping outwardly and rearwardly from the head portion at an angle with respect to an axis of the tool pick and a pair of side surfaces connecting the outer surface of the fin to the head portion. A rear end of each fin is located rearward of the junction between the head portion and the shoulder. The fins define a maximum diameter of at least about 105% of the diameter of the shoulder such that the outer surface of the fin at an axial position aligned with the junction is located radially outward with respect to the junction.

Another exemplary tool pick includes a head portion, a shoulder positioned rearwardly adjacent to the head portion, the head portion having a diameter less than about 75% of a diameter of the shoulder, a puller groove positioned rearwardly adjacent to the shoulder, the puller groove having a diameter less than the diameter of the shoulder, and a shank extending rearwardly from the puller groove. Two or more fins extending generally radially outward from the head portion and the shoulder. Each fin has an outer surface sloping outwardly and rearwardly from the head portion at an angle of between about 23 degrees and about 30 degrees with respect to an axis of the tool pick and a pair of side surfaces connecting the outer surface of the fin to the head portion, each fin terminating at a rear end of the shoulder. The fins define a maximum diameter of at least about 105% of the diameter of the shoulder. A first length is defined from a front end of the head portion to the rear end of the shoulder, and a second length is defined from the front end of the head portion to a rear end of the puller groove, the second length being less than or equal to about 125% of the first length.

An exemplary mining machine includes a rotatable member and one or more tool picks mounted on the rotatable member. The tool pick includes a head portion having a diameter, a shoulder positioned rearwardly adjacent to the head portion and joined to the head portion at a junction, the shoulder having a diameter greater than the diameter of the head portion, and a shank extending rearwardly with respect to the shoulder. Two or more fins extend generally radially outward from the head portion and the shoulder. Each fin has an outer surface sloping outwardly and rearwardly from the head portion at an angle with respect to an axis of the tool pick and a pair of side surfaces connecting the outer surface of the fin to the head portion, each fin having a rear end located rearward of the junction between the head portion and the shoulder. The fins define a maximum diameter of at least about 105% of the diameter of the shoulder such that the outer surface of the fin at an axial position aligned with the junction is located radially outward with respect to the junction.

An exemplary method of manufacturing of a tool pick includes forming a shoulder having a diameter, forming a head portion frontwardly adjacent to the shoulder, the head portion having a diameter less than about 75% of the diameter of the shoulder, and forming a shank extending rearwardly with respect to the shoulder. The method further includes forming two or more fins extending generally radially outward from the head portion and the shoulder, each fin having an outer surface sloping outwardly and rearwardly from the head portion at an angle with respect to an axis of the tool pick and a pair of side surfaces connecting the outer surface of the fin to the head portion, each fin having a rear end located rearward of the junction between the head portion and the shoulder, the fins defining a maximum diameter of at least about 105% of the diameter of the shoulder such that the outer surface of the fin at an axial position aligned with the junction is located radially outward with respect to the junction.

It is to be understood that both the foregoing general description and the following detailed description are exemplary and explanatory and are intended to provide further explanation of the invention as claimed.

BRIEF DESCRIPTION OF THE DRAWING

The following detailed description can be read in connection with the accompanying drawings in which like numerals designate like elements and in which.

DETAILED DESCRIPTION

Figure 4:
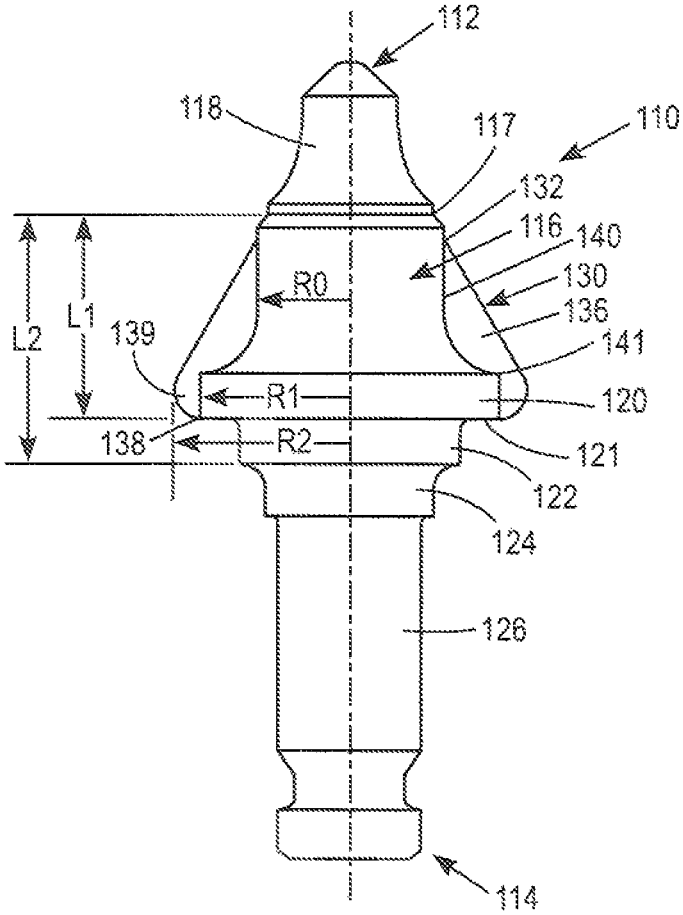
FIG. 4 is a side view of a pick having extended fins.
Figure 5:
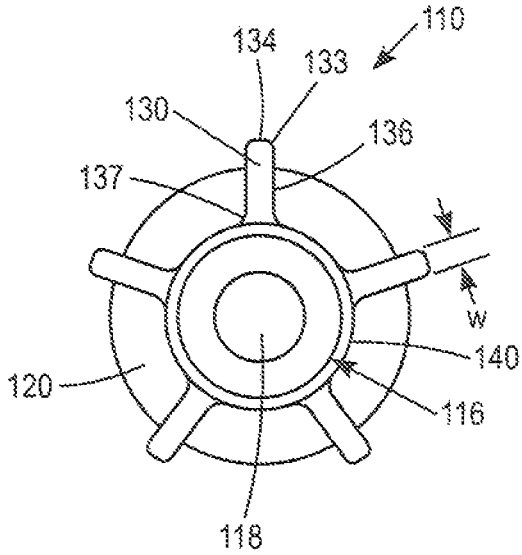
FIG. 5 is a top end view of the pick having extended fins of FIG. 4.
Figure 6:
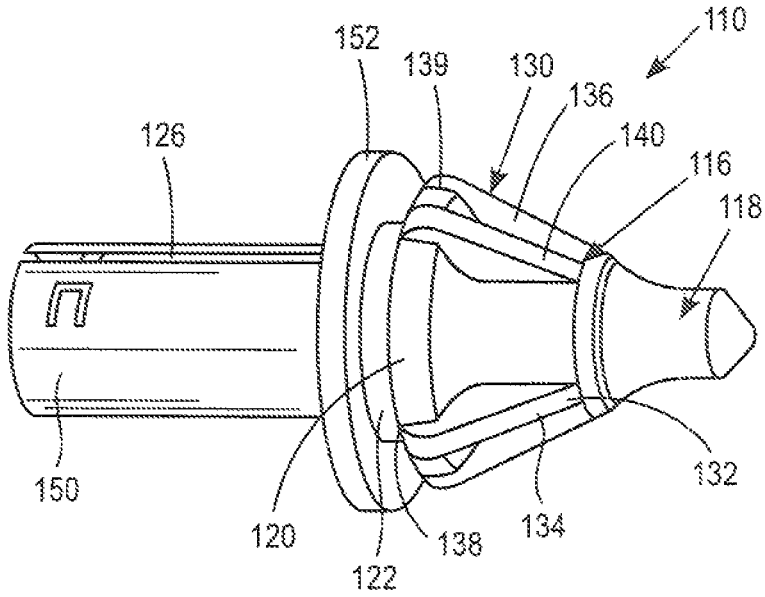
FIG. 6 is a side perspective view of the pick having extended fins of FIG. 4 shown with a sleeve retainer and washer.

FIGS. 4-6 illustrate an embodiment of a tool pick 110 having extended fins 30 for promoting rotation and penetration of the pick 110. The pick 110 has a front end 112 and a rear end 114. The pick 110 includes a tapered head portion 116, a cutting tip 118 projecting frontwardly from the head portion 116, and a shoulder 120 located rearwardly adjacent to the head portion 116. The head portion 116 and the shoulder portion 116 are joined at a junction 141. A reduced diameter puller groove 122 is disposed rearwardly adjacent to the shoulder 120, and is sized to receive the jaws of a standard extractor tool, as known in the art. Projecting rearwardly form the puller groove 122 is a shank 126 having a diameter sized to be received in a bore in a mounting block (not shown). A tapered portion of the shank 126 immediately adjacent to the puller groove 122 may have a diameter slightly larger than that of the shank 126 to serve as a washer seat 124. As shown in FIG. 6, the pick 110 is mounted in a holder 200 having a circular bore (not shown) adapted for receiving the shank 126 such that the shank 126 can rotate within the bore of the holder 200 during use of the pick 110.

A plurality of fins 130 are spaced generally equally about the circumference of the head portion 116. Each fin 130 has a front end 132 and a rear end 138, and extends radially outwardly from an outer surface 140 of the head portion 116. The characteristics of each fin 130 will be discussed with reference to "the fin 130," it being understood that the pick 110 can have any number of fins greater than or equal to two. In a preferred embodiment, as depicted in the figures, the pick 110 has five fins 130 generally equally spaced about the circumference of the head portion 116. However, in certain circumstances, a pick 110 having, for example three fins 130, four fins 130, or six fins 130 may perform just as well or better than a pick 110 having five fins 130.

The front end 132 of the fin 130 joins the head portion 116 at or near a front end 117 of the head portion 116, and the rear end 138 of the fin 130 is located rearward of the junction 141 between the head portion 116 and the shoulder 120. In the depicted embodiment, the rear end 138 of the fin 130 is substantially aligned with a rear end 121 of the shoulder 120. The fin 130 includes a sloped radially outer surface 134 flanked by generally parallel side surfaces 136 that protrude radially outwardly from the outer surface 140 of the head portion 116. The sloped outer surface 134 extends rearwardly and radially outwardly from the head portion 116 at an angle $\alpha$ with respect to an axis of the tool pick 110. The angle $\alpha$ is selected to be sufficiently small to allow grinding debris to be shed from the outer surface 134 without creating excessive wear to the outer surface 134 of the fin 130 but sufficiently large to enable the fin 130 to extend far enough from the head portion 116 to provide adequate surface area on the side surfaces 136 to cause the pick 110 to rotate as debris contacts the side surfaces 136. The angle $\alpha$ can range from about 20 degrees and about 35 degrees and preferably from about 23 degrees to about 30 degrees. In one preferred embodiment the angle $\alpha$ is about 27 degrees. The angle $\alpha$ must be large enough that the outer surface 134 of fin 130 at an axial position aligned with the junction 141 between the head portion 116 and the shoulder 120 is located radially outward of a junction 141. A rounded tail 139 toward the rear end 138 of the fin 130 blends the outer surface 134 into the shoulder 120.

The side surfaces 136 of the pick are generally parallel to each other, but may be slightly tapered such that the fin 130 is slightly thicker at the outer surface 140 of the head portion 116 and slightly thinner at the outer surface 134 of the fin 130. A slight taper of the side surfaces 136 enables debris to be shed more easily from the fin 130 as the debris is pushed rearward along the head portion 116 of the fins 130 during a grinding operation, without causing undue wear to the fin 130. The side surfaces 136 may join the outer surface 134 of the fin 130 at substantially sharp corners. Alternatively, rounded or chamfered corners 136 may provide a smoother transition surface between each of the side surfaces 136 and the outer surface 134. Similarly, the side surfaces 136 may join the outer surface 140 of the head portion 116 at sharp corners, or rounded internal corners 137 may be provided to smooth the transition and to enhance shedding of grinding debris and reduce wear on the fin 130 and head portion 116.

Each fin 130 has a width w that is between 10% and 40% of the diameter of the head portion 116. In one embodiment, the width w of the fin 130 is about 15% of the diameter of the head portion 116.

When the pick 110 is used for grinding or milling, the tip portion 118 contacts a target surface or material to be ground or milled and generates debris such as dust, dirt, and loose grindings. As the tip portion 118 penetrates the target surface, the debris is pushed rearwardly with respect to the pick 110, the debris moving in a random or turbulent fashion with varying components of lateral movement as it is urged rearward. Accordingly, as the debris contacts the side surfaces 136 of the several fins 130, the debris applies forces to the side surfaces 136 that are somewhat random and continually varying in magnitude and direction. A component of these forces is generally perpendicular to the side surfaces 136 of the fins 130 (i.e., tangential to a circumference about the axis of the tool pick 110), and thus urges the tool pick 110 to rotate about its axis within the bore of its holder 200.

Figure 1:
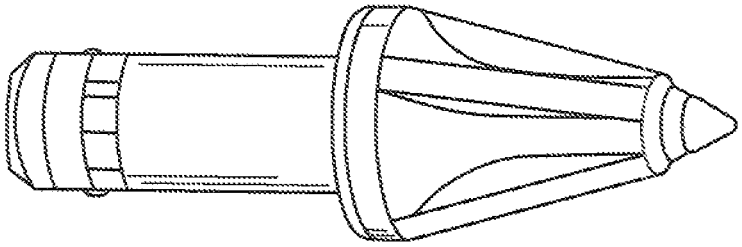
PRIOR ART FIG. 1
FIG. 1 is a side perspective view of a prior art mining pick having fins that are bounded in length and diameter by a shoulder of the pick.

It is known that torque equals the product of radial distance from an axis of rotation and force applied perpendicularly to a radius extending from the axis of rotation. Therefore, the torque provided to rotate the pick 110 can be increased by increasing the radial distance by which the side surfaces 136 of the fins 130 protrude with respect to the axis of the pick 110. As shown in FIG. 4, the head portion of the pick 110 has a radius of R0, the shoulder 120 has a radius of R1, and each fin 130 has a maximum radius of R2. (Radius is used herein rather than diameter since each fin 130 extends outwardly in one direction from the head portion 116, it being well understood that the diameter of axially symmetric parts such as the head portion 116 is simply twice the radius.) By extending the maximum radius R2 of the fins 130 radially outward beyond the shoulder 120, greater torque can be obtained to rotate the pick 110 and to overcome debris between the pick 110 and the holder 200. Therefore, the maximum radius R2 of the fin 130 is equal to or greater than 105% of the radius R1 of the shoulder 120. Preferably, the maximum fin radius R2 is equal to or greater than 115% of the shoulder radius R1, and in one preferred embodiment the maximum fin radius R2 is equal to about 122% of the shoulder radius R1. In contrast, even conventional mining picks with fins, as shown in FIG. 1, have constrained the maximum radius of the fins to be no greater than the radius of the shoulder.

In addition to providing for increased rotation of the pick 110 during grinding, the fins 130 act as gussets or buttresses that enable a reduction in the diameter of the head portion 116 of the pick 110 without a loss of strength. In particular, the fins 130 serve to prevent deformation of the head portion 116 under heavy grinding loads. Thus, the same grinding force can be applied using a head portion 116 having a smaller diameter, which saves material cost and weight. More importantly, a smaller diameter head portion 116 enables the pick 110 to penetrate more readily into a target surface because the same grinding force can be concentrated on a smaller area. Moreover, reducing the diameter of the head portion 116 exposes more of the side surfaces 136 of the fins 130 to enable grinding debris to act on a larger area and thus create enhanced rotation of the pick 110.

Figure 2:
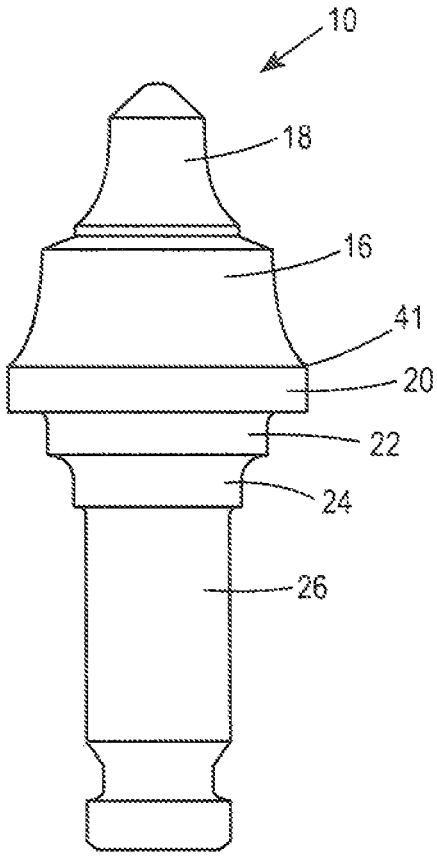
FIG. 2 PRIOR ART
FIG. 2 is a side view of a prior art road milling pick without fins.
Figure 3:
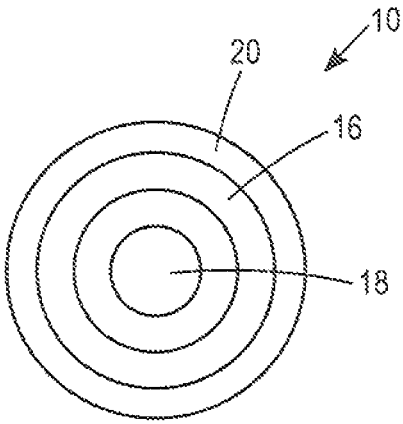
FIG. 3 PRIOR ART
FIG. 3 is a top end view of the prior art road milling pick of FIG. 2.

In a conventional road milling pick 10, such as in FIGS. 2-3, the head portion 16 has a radius that is about 75% to about 85% of the radius of the shoulder 20. In contrast, in the tool pick 110 as in FIGS. 4-6, the radius of the head portion 116 can be reduced to less than 75% of the radius of the shoulder 120, and preferably to less than or equal to about 65% of the radius of the shoulder 120. In one embodiment, the radius of the head portion 116 is about 63% of the radius of the shoulder 120. A head portion 116 having a radius of only about 63% of the radius of the shoulder 120 has a cross-sectional area only about 55% to about 75% that of a conventional road milling pick 10, which means that the penetration of pick 110 including a head portion 116 may be improved by between about 40% and about 80% as compared with a conventional pick 10 when the same milling force is applied.

Moreover, to further increase the debris contact area of the side surfaces 136 of the fins 130, the fins 130 can be lengthened as compared with the length of the head portion 16 of a conventional pick 10. As shown in FIG. 4, the distance from the front end 117 of the head portion 116 to the rear end 121 of the shoulder 120 is designated as L1, while the distance from the front end 117 of the head portion 116 to the junction between the puller groove 122 and the washer seat 124 is designated as L2. In the disclosed embodiment, L1 also designates the length of the fins 130. To maximize the debris contact area of the side surfaces 136 of the fins 130, the distance L1 can be extended as compared with a conventional tool pick 10, without disturbing the length L2, such that a puller groove can be maintained and the distance of the cutting tip 118 from the holder 200 can be maintained while improving the rotation and penetration of the pick 110.

For example, a conventional tool pick 10 has a distance from the front end 17 of the head portion 16 to the junction of the puller groove 22 and the washer seat 24 that is about 150% of the distance from the front end 17 of the head portion 16 to a rear end 21 of the shoulder (i.e., the puller groove 22 is about half as long as the head portion 16 plus the shoulder 20). In contrast, the tool pick 110 has a distance L2 that is equal to or less than 125% of the distance L1, and preferably equal to or less than about 120% of the distance L1, such that for the same distance L2, the fins 130 can be at least about 20% longer than they would be if a conventional length head portion, shoulder, and puller groove were used. And because the fins 130 provide a gusseting effect on the head portion 116, the longer head portion 116 is prevented from deformation during grinding even at this extended length. Additionally, the shorter puller groove 122 is still sufficiently long to accommodate a standard puller tool.

In one preferred embodiment, the tool pick 110 includes a shoulder 120 with a radius R2 of about 0.83 inches, a head portion 116 with a radius R0 of about 0.43 inches, and fins 130 each with a radial dimension R1 of about 0.68 inches, each fin 130 having a width w of about 0.085 inches to about 0.425 inches, and preferably a width w of about 0.125 inches. The combined length L1 of the head portion 116 and the shoulder 120 is about 1.0 inches and the combined length L2 of the head portion, the shoulder, and the puller groove 122 is about 1.2 inches. Five fins 130 are used, equally spaced about the circumference of the pick 110.

The tool pick 110 can be made by various metal forming methods known in the art, including machining, cold heading, and forging. Preferably, the tool pick 110, except for the tip 118, is formed by cold heading or cold forming from a round steel wire to a net shape ready for brazing on the tip 118. After cold heading, a unitary article includes the head portion 116, the fins 130, the shoulder 120, the puller groove 122, and the shank 126, as well as the washer seat 124 if desired. By cold heading the fins 130 as integral parts with the head portion 116 and the shoulder 120, superior strength is achieved as compared with an article made by machining from bar stock. In one embodiment, the tool pick 110, without the tip 118, is cold headed in five or six successive steps from a round steel wire to the net shape finished part.

While the tool pick 110 is generally suitable for use as part of a road milling tool, it should be understood that the tool pick 110 is applicable to tool picks other than for road milling tools, such as for mining and trenching tools. When used as a road milling tool, a plurality of cutting tools are mounted around the circumference of a drum (not shown), and are rotatable around a longitudinal axis of the drum to thereby cut a hard surface.

Although described in connection with preferred embodiments thereof, it will be appreciated by those skilled in the art that additions, deletions, modifications, and substitutions not specifically described may be made without department from the spirit and scope of the invention as defined in the appended claims.

What is claimed is:

1. A tool pick comprising:

a head portion having a diameter;

a shoulder positioned rearwardly adjacent to the head portion and being joined to the head portion at a junction, the shoulder having a diameter greater than the diameter of the head portion;

a shank extending rearwardly with respect to the shoulder; and two or more fins extending generally radially outward from the head portion and the shoulder in a plane, each fin having an outer surface sloping outwardly and rearwardly from the head portion at an angle with respect to an axis of the tool pick and a pair of side surfaces connecting the outer surface of the fin to the head portion, each fin having a rear end located rearward of the junction between the head portion and the shoulder, and the fins defining a maximum diameter of at least about 105% of the diameter of the shoulder such that the outer surface of the fin at an axial position aligned with the junction is located radially outward with respect to the junction, wherein the slope of the outer surface of the fin changes at the rear end of the fin so that the outer surface smoothly connects to the rear end of the shoulder, and wherein the side surfaces of each fin have a width in the radial direction that varies as a function of axial position.

2. The tool pick of claim 1, wherein the fins define a maximum diameter of at least about 115% of the diameter of the shoulder.

3. The tool pick of claim 2, wherein the fins define a maximum diameter of at least about 122% of the diameter of the shoulder.

4. The tool pick of claim 1, wherein the rear end of the fins is aligned with a rear end of the shoulder.

5. The tool pick of claim 4, further comprising a puller groove positioned rearwardly adjacent to the shoulder and having a diameter less than the diameter of the shoulder, wherein a first length is defined from a front end of the head portion to the rear end of the shoulder, wherein a second length is defined from the front end of the head portion to a rear end of the puller groove, and wherein the second length is less than or equal to about 125% of the first length.

6. The tool pick of claim 1, where the two or more fins consist of five fins generally equally spaced around the circumference of the tool pick.

7. The tool pick of claim 1, wherein the diameter of the head portion is less than about 75% of the diameter of the shoulder.

8. The tool pick of claim 7, wherein the diameter of the head portion is less than or equal to about 65% of the diameter of the shoulder.

9. The tool pick of claim 1, wherein the outer surfaces of the fins slope outward from the head portion at an angle of between about 20 degrees and about 35 degrees.

10. The tool pick of claim 9, wherein the outer surfaces of the fins slope outward from the head portion at an angle of between about 23 degrees and about 30 degrees.

11. The tool pick of claim 10, wherein the outer surfaces of the fins slope outward from the head portion at an angle of about 27 degrees.

12. The tool pick of claim 1, wherein the fins each have a width between about 10% and about 20% of the diameter of the head portion.

13. A tool pick comprising:

a head portion;

a shoulder positioned rearwardly adjacent to the head portion, the head portion having a diameter less than about 75% of a diameter of the shoulder;

a puller groove positioned rearwardly adjacent to the shoulder, the puller groove having a diameter less than the diameter of the shoulder;

a shank extending rearwardly from the puller groove; and two or more fins extending generally radially outward from the head portion and the shoulder in a plane, each fin having an outer surface sloping outwardly and rearwardly from the head portion at an angle of between about 23 degrees and about 30 degrees with respect to an axis of the tool pick and a pair of side surfaces connecting the outer surface of the fin to the head portion, each fin terminating at a rear end of the shoulder, and the fins defining a maximum diameter of at least about 105% of the diameter of the shoulder, wherein a first length is defined from a front end of the head portion to the rear end of the shoulder, wherein a second length is defined from the front end of the head portion to a rear end of the puller groove, and wherein the second length is less than or equal to about 125% of the first length, such that the outer surface of the fin at an axial position aligned with the junction is located radially outward with respect to the junction, wherein the slope of the outer surface of the fin changes at the rear end of the fin so that the outer surface smoothly connects to the rear end of the shoulder, and wherein the side surfaces of each fin have a width in the radial direction that varies as a function of axial position.

14. A mining machine, comprising:

a rotatable member; and one or more tool picks mounted on the rotatable member;

wherein the tool pick includes:

a head portion having a diameter;

a shoulder positioned rearwardly adjacent to the head portion and being joined to the head portion at a junction, the shoulder having a diameter greater than the diameter of the head portion;

a shank extending rearwardly with respect to the shoulder; and two or more fins extending generally radially outward from the head portion and the shoulder in a plane, each fin having an outer surface sloping outwardly and rearwardly from the head portion at an angle with respect to an axis of the tool pick and a pair of side surfaces connecting the outer surface of the fin to the head portion, each fin having a rear end located rearward of the junction between the head portion and the shoulder, and the fins defining a maximum diameter of at least about 105% of the diameter of the shoulder such that the outer surface of the fin at an axial position aligned with the junction is located radially outward with respect to the junction, wherein the slope of the outer surface of the fin changes at the rear end of the fin so that the outer surface smoothly connects to the rear end of the shoulder, and wherein the side surfaces of each fin have a width in the radial direction that varies as a function of axial position.

15. A method of manufacturing of a tool pick, the method comprising:

forming a shoulder having a diameter;

forming a head portion frontwardly adjacent to the shoulder, the head portion having a diameter less than about 75% of the diameter of the shoulder;

forming a shank extending rearwardly with respect to the shoulder; and forming two or more fins extending generally radially outward from the head portion and the shoulder in a plane, each fin having an outer surface sloping outwardly and rearwardly from the head portion at an angle with respect to an axis of the tool pick and a pair of side surfaces connecting the outer surface of the fin to the head portion, each fin having a rear end located rearward of the junction between the head, portion and the shoulder, and the fins defining a maximum diameter of at least about 105% of the diameter of the shoulder such that the outer surface of the fin at an axial position aligned with the junction is located radially outward with respect to the junction, wherein the slope of the outer surface of the fin changes at the rear end of the fin so that the outer surface smoothly connects to the rear end of the shoulder, and wherein the side surfaces of each fin have a width in the radial direction that varies as a function of axial position.

* * * * *